US005137065A

United States Patent [19]

Stewart

[11] Patent Number: 5,137,065

[45] Date of Patent: Aug. 11, 1992

[54] WOOD-TURNING CHATTER TOOL

[76] Inventor: Dennis K. Stewart, 2502 NW. 4th Ave., Hillsboro, Oreg. 97124

[21] Appl. No.: 742,887

[22] Filed: Aug. 9, 1991

Related U.S. Application Data

[63] Continuation-in-part of Ser. No. 111,558, Oct. 20, 1987, Pat. No. Des. 318,994, which is a continuation of Ser. No. 111,687, Oct. 20, 1987, Pat. No. 4,924,924.

[51] Int. Cl.[5] ..... B27C 7/02; B27G 17/00

[52] U.S. Cl. ..... 142/56; 30/358; 82/1.11; 142/1; 144/358; 407/9

[58] Field of Search ..... 142/1, 56, 42; 407/8-10; 144/358, 361; 30/358; 82/1.11

[56] References Cited

U.S. PATENT DOCUMENTS 4,640,156 2/1987 Nakagawa et al. ..... 82/1.11
4,924,924 9/1990 Stewart ..... 142/49

OTHER PUBLICATIONS

"Chatterwork: A Risky Path to a Faceted Finish" by Stephen Paulson, in *Fine Woodworking Techniques* 8 (Newtown, CT: Taunton Press, Oct. 1986), pp. 137-139.

*Primary Examiner*—Steven C. Bishop
*Attorney, Agent, or Firm*—Bruce J. Ffitch

[57] ABSTRACT

A lathe tool includes a stiff shank and handle portion and, adjustably extending forward from the shank, cantilever fashion, an elongated resilient blade. The combination is configured and disposed on a tool rest so that, when the tip of the blade engages a downwardly moving surface of a workpiece, a vibration or chatter of the blade results and produces a three dimensional textured pattern on the workpiece. Pattern and texture may be selectively varied by adjusting the unsupported length of the blade (to control its frequency of vibration), by changing speed of rotation of the workpiece, by changing pressure of the tool blade on the workpiece, and by lateral and rotational manipulation of the tool.

16 Claims, 1 Drawing Sheet

WOOD-TURNING CHATTER TOOL

This application is a continuation-in-part of my copending design patent application Ser. No. 07/111,558 filed Oct. 20, 1987 and now U.S. Pat. No. Des. 318,994, which is a continuation of utility patent application Ser. No. 07/111,687, filed Oct. 20, 1987 and now U.S. Pat. No. 4,924,924.

BACKGROUND OF THE INVENTION

The invention concerns turning tools used in producing generally cylindrical or tapered workpieces in a lathe and more particularly to tools for producing a patterned or textured surface on the workpiece.

As is known, surface finishes of desirable texture or pattern may be obtained by allowing controlled chatter of a lathe tool in its engagement with the workpiece. In general chatter—vibration of a cutting tool or of the work in a machine, caused by insufficient rigidity of either—results in noise and uneven finish of the surface of the workpiece. On the other hand intentional or controlled chatter can be used creatively and selectively to achieve desirable decorative surface textures on a turned object.

In a known method of lathe chatter work a conventional tool is held loosely by the lathe operator so as to permit the chatter to occur. But for consistent or sustained successful results considerable skill is required. Alternatively, the workpiece itself may vibrate while the tool as a whole remains rigid and firmly held. But this second method is applicable only to slender flexible pieces and thus limited in scope.

SUMMARY OF THE INVENTION

Accordingly an object of the invention is to provide a lathe tool for chatter work which does not rely for the production of chatter substantially entirely on the control of the lathe operator but which has an inherent or self-contained a chatter producing nature and which may be used to create chatter work on the non-yielding surfaces of workpieces of a wide variety of shapes and sizes.

This object may be realized in an elongated resilient tool working element or blade which is supported extending cantilever fashion from a tool-holder, and which is firmly supported in such an attitude that, upon engagement of the workpiece, the tip of the blade tends to be deflected in a direction away from the workpiece surface and the resilience of the blade in engagement with the surface of the workpiece sets up a vibration in the cantilevered portion of the blade.

In a preferred combination the resilient element or blade may be used with a tool holder which permits adjustment of its unsupported length for varying the natural frequency of vibration or chatter according to the texture and pattern of surface finish desired.

An important advantage is that, freed from the need to concentrate on simply holding a tool loosely so as to generate a chattering condition between tool and workpiece, the lathe operator can hold a tool combination according to the invention firmly and use his energy and devote his concentration to its manipulation so as to develop and refine an enhanced range of surface textures and patterns.

Chatter tools according to the invention may be used successfully for a range of materials including various woods, plastics, soft metals and ivory or ivory substitutes. However in the discussion which follows it will generally be assumed that the working medium is wood.

DESCRIPTION OF THE PREFERRED EMBODIMENTS

Figure 1:
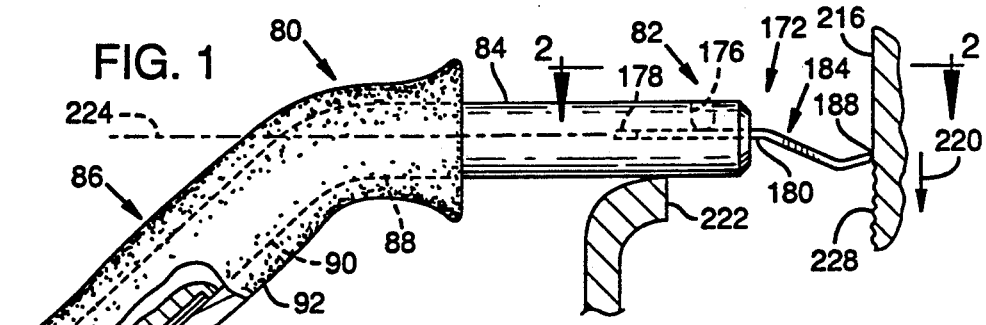
FIG. 1 is a right-hand side elevation of a lathe tool embodying the invention, supported on a tool rest and engaging a workpiece.
Figure 3:
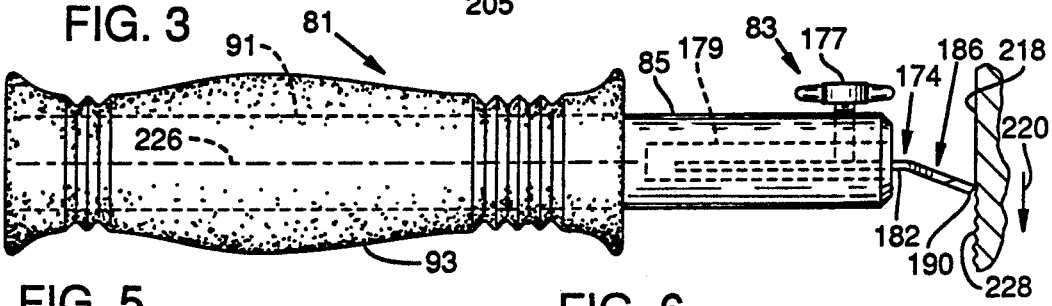
FIG. 3 is a side elevation similar to FIG. 1 of a second embodiment of the invention.

The invention is embodied in the exemplary lathe tool assemblies 80, 81 shown in FIGS. 1 and 3.

The embodiment 80 of FIG. 1 includes a forward working portion 82 integral with a shank 84 and a butt portion 86 diverging downwards from a transition 88 to form a handle portion 90 cushioned by a hand grip 92. The hand grip 92 is preferably of a resilient material somewhat stretched to fit over the butt handle portion 90, so as to retain a small wrench or key 94, used in tool adjustment, stowed in a key-like slot or groove 96 on the underside of the handle 90.

The embodiment 81 of FIG. 3 includes a forward working portion 83 integral with a shank 85 and a handle portion 91 cushioned by a hand grip 93.

In each of the tool working portions 82, 83 shown in FIGS. 1 and 3 the principal element is the blade, 172, 174 respectively, with the form of FIG. 1 being particularly suited to metal working while that of FIG. 3 works well in wood cutting. In each case the blade is supported cantilever fashion, clamped by a setscrew 176, 177 retaining it in a slot 178 or socket 179 in a forward extension of the shank 84, 85. In both cases the blade is made of resilient steel and clamped or held by a tongue portion 180, 182 within the slot 178 or socket 179 while a cantilevered portion 184, 186 slopes forwardly and downwardly to a cutting tip 188, 190. In the metal working version (FIGS. 1 and 2) the tip 188 is bent upwards to an angle somewhat above the horizontal, but in both cases the working tips 188, 190 are carried at a level approximately coinciding with the lower side of the shank portion 84, 85.

Figure 4:
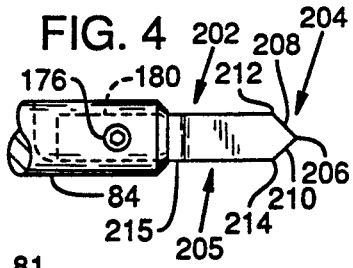
FIG. 4 is a view similar to FIG. 2 showing an alternative shape for the working tip of the chatter blade.
Figure 2:
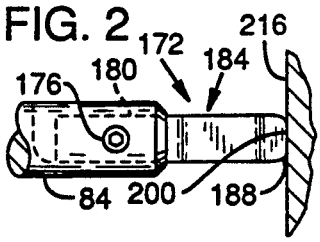
FIG. 2 is a partial overhead view of the embodiment of FIG. 1 taken approximately on line 2—2 of FIG. 1.

As seen best in FIG. 2 the cutting tip of blade 172 is relatively blunt and has only a single extended working edge 200. The blade 202 shown in FIG. 4 is more versatile and the pointed tip 204 of the cantilevered portion 205 comprises five working features—point 206, left and right hand edges 208, 210 and left and right hand corners 212, 214. The blade 202 is held and clamped by means of tongue portion 215.

Control, comfort and convenience in operation are provided in integrated chatter tool combinations according to the invention and exemplified by the configurations shown in the drawings.

In typical turning operation tools are usually supported on generally horizontally extending rests (see rest 222 in FIG. 1 for example) and tool working portions and shanks are maintained approximately in a horizontal plane approximately defined by the tool rest and passing through the axis of rotation of the workpiece. In all discussion herein it is assumed that a workpiece surface 216, 218 engaged by a tool is moving downwards relative to the tool as indicated by arrows 220.

In operation the rotational position of the tool working portion or shank supported by a rest may be adjusted to optimize the attitude of the cutting portion of the tool to the workpiece. In any elongated tool therefore such as the tools shown in FIGS. 1 and 3 the longitudinal axes 224, 226 of the shanks 84, 85 may be considered axes of rotational adjustment.

Operator control of a chatter tool blade is particularly facilitated by the configuration of the combination of FIG. 1. The handle 86 diverges from the axis of rotational adjustment (224) just defined so that the turner's hand (usually the right) grasping the handle not only contributes to the balance of forces in a vertical plane, but also, because of the radial extension of the handle outwards from the axis of rotational adjustment (shank supported on the rest), gives the turner sufficient mechanical advantage in a torsional direction, to comfortably control the rotational attitude of the tool. He is well positioned not only to balance any torsional forces induced in the tool by a resultant cutting force offset from the axis of rotational adjustment, but also to finally control the attitude of the workpiece engaging portion of the tool. A relatively large movement of his hand results in only a small movement of the tool cutting edges (if these are close to the axis of rotational adjustment), so that very precise control can be maintained. Similarly a greater overall length of lathe tool assembly has the potential for achieving more precise control of the tool in vertical and horizontal directions. The design of the tool permits comfortable control with one arm so that the turner's other hand (usually the left) is free, if desired, to steady the tool close to the rest, possibly grasping the rest and the tool together, to provide a fulcrum for tool movement or adjustment.

Successful operation of the chatter tool assemblies or combinations shown in the drawings depends in part on establishing a frequency of oscillation for the blade cantilevered portions 184, 186, 205 effective to produce a desired texture and pattern on the surface of the workpiece. Conventionally chatter work is done with a tool having a rigid blade, held loosely by the turner so that vibration or oscillation can take place. With tools according to the present invention, desired results are much more predictably and consistently obtained. The tool is held firmly on a rest such as rest 222 shown in FIG. 1 and for a given speed of the work piece surface relative to the tool, and for a given material, the frequency of oscillation or vibration of the blade depends on the length of the cantilevered portion of the blade. Frequency characteristic is readily changed by adjusting the cantilevered or free length 184, 186, 205 of the blade by loosening and tightening the set screw 176, 177. Best results are obtained by using a blade form and tip suited to the material being worked. For example, a chatter tool for metal working requires the more aggressive chatter inducing form 184 of FIG. 1 with the upwardly or forwardly raked tip 188. For relatively softer material such as wood the simple backwardly raked form 186 of FIG. 3 gives good results. For many desired effects, the overall cantilevered length of the blade may be about one inch, while its cross section is about ¼ to ⅜ths of an inch wide by 1/16th of an inch thick. The cantilevered portions 184, 186, 205 may be bent or inclined below the horizontal anywhere from zero to 90 degrees (but the 30 degrees shown here works particularly well). To form the upwardly inclined tip of FIG. 12 about ¼ to ⅜ths of an inch length of the blade portion 184 should be bent upwards to an above horizontal attitude. Clearly in an undeflected condition the working tip (188, 190, 206) of each blade should be somewhat below the tongue portion 180, 182, 215 to avoid jamming.

Figure 5:
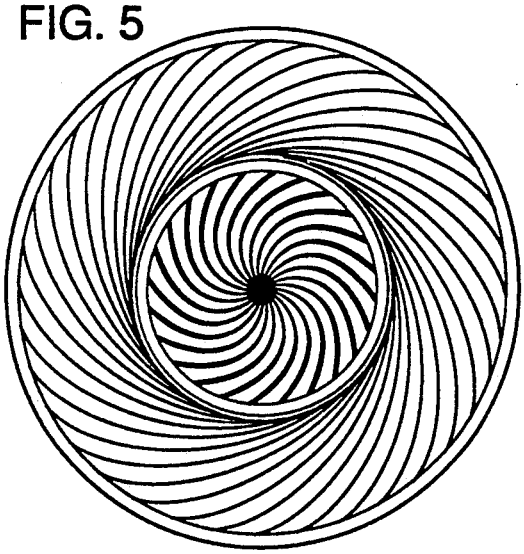
FIGS. 5 and 6 represent graphical approximations of examples of workpiece surface textured patterns which may be obtained with chatter blade tools according to the invention.
Figure 6:
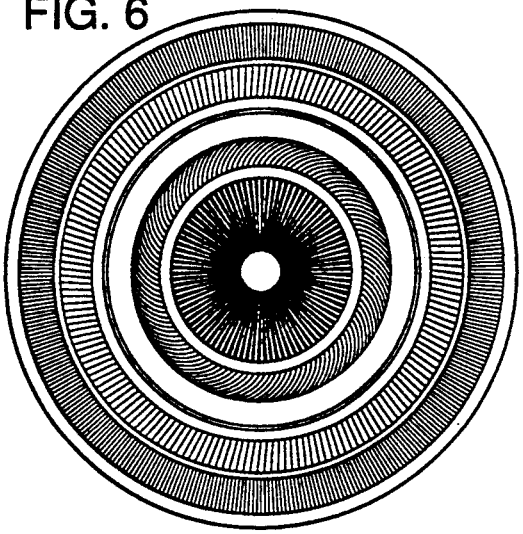

Chatter tools according to the invention may be used to create decorative textures on turned objects, for example in adding a touch of elegance to boxes, lids, endgrain bowls, jewelry, and special inserts for bottles and hollow vessels. Examples of textured patterns which may be obtained are illustrated in FIGS. 5 and 6.

For clearly defined, intricate patterns, chatter work should be applied to the endgrain of very hard, fine grained woods without figure. Ebony, African blackwood, lignum vitae, boxwood, etc. may be used. Other materials which work very well are acrylics and other plastics, ivory or ivory substitutes, tagua nuts, and soft metals.

Chatter work is applied to the surface of an object while it is turning on a lathe. Note that the tool rest is placed at the center level of the piece far enough away to allow the shank of the chatter tool to be placed upon the tool rest (such as shank 84 on rest 222 in FIG. 1). The flexible blade cantilevered portion (184, 186, 205) should not be placed directly on the tool rest.

Before applying chatter work, the surface of the workpiece should be true and smooth. Some light, finish scraping cuts may be required. In operation the shank of the tool (84, 85) should be placed on the tool rest (222) and the tip may be angled slightly downward so that the blade can make contact with the surface of the workpiece near the center level. The effective angle between the top of the blade and the surface of the piece should be less than about 80 degrees. This will allow the blade to move away from the surface when it starts to vibrate rather than dig in.

To begin chatter work the blade is brought into contact with the rotating surface of the workpiece and as pressure is applied the blade begins to vibrate. Each time the blade makes contact with the surface it scrapes a small mark on it. In a short time hundreds of marks or serrations are scraped into the surface, leaving an intricate pattern of chatter work. (Serrations are indicated diagrammatically at 228 in FIGS. 1 and 3). As described above, the length of the cantilevered or unsupported portion of the blade (184, 186, 205) extending from the tool holder determines the frequency of vibration. Frequency will be relatively higher for shorter blades, lower for longer blades. Spacing of "marks" on the workpiece surface is determined by the combination of frequency of vibration of the chatter tool blade and the surface speed of the workpiece. A short blade and a slow speed result in close spacing of the marks.

A third variable affecting resultant pattern and texture is tool pressure on the workpiece. More pressure makes the texture deeper. Also, sideways movement of the blade, pulling it across the surface, affects the density of the pattern. A fast side pull will spread a small number of marks over a wide area. A slow side pull will compact the marks close together sideways.

The versatile pointed tip blade 202 of FIG. 4 may be used in a number of ways. For example, the straight edges 208, 210 will make a series linear marks when applied parallel to the workpiece surface, as in much of the pattern of FIG. 6. Patterns so produced usually turn out best with short blade lengths and slower speeds, so that the lines are close together. The point of the blade 206 will make a V-groove with chatter marks if pressed directly into the wood without any side movement. With either of these techniques, pressure should be applied to the workpiece until the chatter noise peaks. The blade should then be quickly retracted straight away from the surface. Slower removal allows the blade to knock the peaks off the chatter pattern just created. Yet another texture variation may be produced by using the side corners 212, 214 of the pointed blade 202.

By moving the blade sideways after it starts to vibrate the area covered by a pattern such as the line pattern may be extended. But to keep the line continuous, the side movement of the blade must be parallel to the cutting edge. A broken line pattern will result from side movement that is not parallel to the edge.

Side movement of the pointed tip 206 may be used to create wide bands of spiralling marks of the general type suggested by FIG. 5. A fine lacy pattern can be created by rotating the tool about 45 degrees so that the blade vibrates in a diagonal motion. When used with light pressure and a fast side pull, this will produce fine squiggling lines which overlap slightly to create a delicate woven pattern.

For the most pleasing overall effect, chatter work is best used sparingly with plenty of smooth surfaces surrounding it, to set it off. Chatter work may also be highlighted by cutting small grooves on both sides of a band to frame it. Varying the frequency and type of pattern when using several bands of chatter work on the same piece makes it more interesting.

Careful finishing may improve the chatter work. For patterns with a smooth background, light sanding will bring out the contrast between the marks and the background. Sanding deeper textures without a smooth background will flatten and polish the high points which also increases the contrast. Using fine steel wool or very fine abrasive pads instead of sand paper will polish but not flatten the high points, giving a softer look. For extremely high contrast contrasting paints, shoe polish, or decorative waxes may be applied. The material used should be rubbed into the texture, and the surface then buffed to remove it from all untextured areas. For finishing, a light oil or wax is recommended. Any excess finish should be rubbed out from the texture.

Compared with the "loose tool" or "loose/vibrating work" methods, use of tools according to the invention to produce chatter work makes possible higher vibration frequencies and hence closer, more detailed patterns. Such techniques as angling sideways or partially rotating the blade, introducing a lateral component into the vibration, make additional variations of pattern and texture possible. Overall, the turner has more control of the process and more scope for creative embellishment.

I claim:

1. An elongated hand-held lathe tool assembly for use by a turner for operation in a generally horizontal plane of use and in cutting engagement with a surface of a rotating workpiece, in operation the surface moving downwards relative to the tool assembly and the tool assembly being at least partially supported by a tool rest, comprising:

an elongated shank having forward and rearward ends and a longitudinal axis said forward end including a blade holding means; and a flat elongated resilient blade carried by the blade holding means and having a free portion extending cantilever fashion forwards and downwards and said free portion having a forward cutting portion with a forward tip for engaging the workpiece surface, the tip being bent upwards relative to the forwardly and downwardly sloping free portion, so that the blade tip is inclined forwardly and upwardly and said workpiece surface engagement tending to deflect the blade downwards and the resilience of the blade tending to restore it to an undeflected position, so that a chatter is established in the tool blade, producing chatter marks on the workpiece surface.

2. An elongated hand-held lathe tool assembly for use by a turner for operation in a generally horizontal plane of use and in cutting engagement with a surface of a rotating workpiece, in operation the surface moving downwards relative to the tool assembly and the tool assembly being at least partially supported by a tool rest, comprising:

an elongated shank having forward and rearward ends and a longitudinal axis said forward end including a blade holding means;

a flat elongated resilient blade carried by the blade holding means and having a free portion extending cantilever fashion forwards and downwards and said free portion having a forward cutting portion for engaging the workpiece surface, said workpiece surface engagement tending to deflect the blade downwards and the resilience of the blade tending to restore it to an undeflected position, so that a chatter is established in the tool blade, producing chatter marks on the workpiece surface; and wherein the blade holding means includes releasable clamp means, and the blade has a rearwardly extending tongue for reception by the clamp means and said clamp means are operable to permit generally fore and aft adjustment of the blade so as to vary the length of the cantilevered portion of the blade, and hence, in operation vary the frequency of chatter.

3. The tool assembly of claim 2 wherein the clamp means holds the blade tongue approximately parallel to the axis of the shank.

4. The tool assembly of claim 2 wherein, in operation, the angle between the forwardly and downwardly inclined free portion of the cutter blade and the horizontal is between approximately 0 degrees and 90 degrees.

5. An elongated hand-held lathe tool assembly for use by a turner for operation in a generally horizontal plane of use and in cutting engagement with a surface of a rotating workpiece, in operation the surface moving downwards relative to the tool assembly and the tool assembly being at least partially supported by a tool rest, comprising:

an elongated shank having forward and rearward ends and a longitudinal axis said forward end including a blade holding means;

a flat elongated resilient blade carried by the blade holding means and having a free portion extending cantilever fashion forwards and downwards and said free portion having a forward cutting portion for engaging the workpiece surface, said workpiece surface engagement tending to deflect the blade downwards and the resilience of the blade tending to restore it to an undeflected position, so that a chatter is established in the tool blade, producing chatter marks on the workpiece surface; and a rearwardly and downwardly extending butt member comprising a handle for gripping by the turner for at least partially controlling the tool, and a transition member for connecting the butt member to the shank.

6. The tool assembly of claim 5 wherein the butt member, shank, and blade all have longitudinal axes and said axes are substantially coplanar.

7. The tool assembly of claim 5 wherein the butt member, shank and transition member together comprise a single bar of material of uniform cross section, and wherein the butt member carries grip means for assisting the turner in controlling the tool.

8. The tool assembly of claim 7 further including elongated pocket means extending within the grip means parallel to the axis of the butt member for receiving and holding a key for operating the clamping means.

9. An elongated hand-held lathe tool for use by a turner for operation in a generally horizontal plane of use and in cutting engagement with a surface of a rotating workpiece, in operation the surface moving downwards relative to the tool and the tool being at least partially supported by a tool rest, comprising:

a rearward rigid tool portion for being held firmly by the turner and being supported by the rest, said portion having a longitudinal axis;

a forward resilient tool portion extending generally forwardly and cantilever fashion from the rigid tool portion; releasable clamping means for securing the resilient portion to the rigid portion and permitting fore and aft adjustment of the resilient portion relative to the rigid portion so that the effective length of the resilient portion may be adjusted; and a forward cutting tool portion included in the resilient portion for engaging the workpiece surface, said engagement with the workpiece surface tending to deflect the cutting portion downwards and the resilience of the resilient portion tending to restore it to an undeflected position so that a chatter is established in the resilient portion, producing chatter marks on the workpiece surface.

10. The tool of claim 9 wherein the resilient tool portion comprises an elongated flat blade.

11. The tool of claim 10 wherein the cutting portion includes at least one cutting edge having a linear extent, for parallel engagement with the surface of the workpiece when in use.

12. The tool of claim 9 wherein the resilient portion extends forwardly and downwardly from the rigid portion.

13. The tool of claim 9 wherein the rigid portion includes an elongated handle portion diverging from the longitudinal axis.

14. An elongated resilient chatter tool blade for being adjustably held in a tool holder, extending forward cantilever fashion from the tool holder, the combination of holder and tool being for hand-held use by a turner for operation in a generally horizontal plane of use with a forward portion of the blade in cutting engagement with a surface of a rotating workpiece, in operation the surface moving downwards relative to the chatter tool blade and the tool holder being at least partially supported by a tool rest, comprising:

a rearward tongue portion of the blade for being held by the tool holder and a forward portion connected to the tongue portion and including at least one cutting edge for engagement with the workpiece surface, said engagement with the workpiece surface tending to deflect the forward portion downwards and the resilience of the chatter tool blade tending to restore it to an undeflected position so that a chatter is established in the blade, producing chatter marks on the workpiece surface.

15. The chatter tool blade of claim 14 wherein, in use, the forward portion of the blade extends forwardly and downwardly from the tongue portion.

16. An elongated hand-held lathe tool assembly for use by a turner for operation in a generally horizontal plane of use and in cutting engagement with a surface of a rotating workpiece, in operation the surface moving downwards relative to the tool assembly and the tool assembly being at least partially supported by a tool rest, comprising:

an elongated shank having forward and rearward ends and a longitudinal axis, said forward end including a blade holding means;

a rearwardly extending butt member comprising a handle for gripping by the turner for at least partially controlling the tool, and a transition member for connecting the butt member to the shank; and an elongated resilient chatter tool blade having a rearward tongue portion for being held by the blade holding means and extending forwardly in cantilever fashion, and a forward portion connected to the tongue portion and including at least one cutting edge for the engagement with the workpiece surface, said engagement tending to deflect the forward portion downwards and the resilience of the chatter tool blade tending to restore it to an undeflected position so that a chatter is established in the blade, producing chatter marks on the workpiece surface.

* * * * *